US009556526B2

(12) United States Patent
Longhenry et al.

(10) Patent No.: US 9,556,526 B2
(45) Date of Patent: Jan. 31, 2017

(54) GENERATOR AND METHOD FOR FORMING HYPOCHLOROUS ACID

(71) Applicant: Tennant Company, Minneapolis, MN (US)

(72) Inventors: Daniel P. Longhenry, Bloomington, MN (US); Daniel L. Joynt, Columbus, MN (US)

(73) Assignee: TENNANT COMPANY, Minneapolis, MN (US)

( * ) Notice: Subject to any disclaimer, the term of this patent is extended or adjusted under 35 U.S.C. 154(b) by 421 days.

(21) Appl. No.: 13/929,152

(22) Filed: Jun. 27, 2013

(65) Prior Publication Data

US 2014/0001053 A1 Jan. 2, 2014

Related U.S. Application Data

(60) Provisional application No. 61/666,379, filed on Jun. 29, 2012.

(51) Int. Cl.

| | |
|---|---|
| ***C25B 1/22*** | (2006.01) |
| ***C25B 1/26*** | (2006.01) |
| ***C25B 9/08*** | (2006.01) |
| ***C25B 15/02*** | (2006.01) |

(52) U.S. Cl.

CPC . *C25B 1/22* (2013.01); *C25B 1/26* (2013.01); *C25B 9/08* (2013.01); *C25B 15/02* (2013.01)

(58) Field of Classification Search

CPC ..... C25B 1/24; C25B 1/22; C25B 1/26; C25B 1/265; C25B 2201/4618; C02F 1/461;C02F 1/467; C02F 1/4672; C02F 1/4674

See application file for complete search history.

(56) References Cited

U.S. PATENT DOCUMENTS

| | | | |
|---|---|---|---|
| 4,169,773 | A | 10/1979 | Lai et al. |
| 4,173,524 | A | 11/1979 | McRae |
| 4,781,810 | A | 11/1988 | Tucker |
| 5,374,341 | A | 12/1994 | Aoki et al. |
| 5,445,722 | A | 8/1995 | Yamaguti et al. |
| 5,628,888 | A | 5/1997 | Bakhir et al. |
| 5,651,398 | A | 7/1997 | Decker |
| 5,762,769 | A | 6/1998 | Gotsu et al. |

(Continued)

FOREIGN PATENT DOCUMENTS

| | | | |
|---|---|---|---|
| CN | 101151209 | A | 3/2008 |
| CN | 101384380 | A | 3/2009 |

(Continued)

OTHER PUBLICATIONS

International Search Report and Written opinion dated Oct. 16, 2013 from International Application No. PCT/US2013/048480.

(Continued)

*Primary Examiner* — Steven A. Friday

(74) *Attorney, Agent, or Firm* — David D. Brush; Westman, Champlin & Koehler, P.A.

(57) ABSTRACT

A system and method for generating hypochlorous acid, the system comprising an electrolysis cell, a first fluid line configured to direct a first salt solution to a cathode chamber of the electrolysis cell, and a second fluid line configured to direct a second salt solution to an anode chamber of the electrolysis cell, where the second salt solution has a greater salt concentration than the first salt solution.

16 Claims, 1 Drawing Sheet

(56) References Cited

U.S. PATENT DOCUMENTS

| | | | | |
|---|---|---|---|---|
| 5,858,201 | A | 1/1999 | Otsuka et al. | |
| 5,900,136 | A | 5/1999 | Gotsu et al. | |
| 5,932,171 | A | 8/1999 | Malchesky | |
| 5,997,717 | A | 12/1999 | Miyashita et al. | |
| 6,059,941 | A | 5/2000 | Bryson et al. | |
| 6,113,853 | A | 9/2000 | Nakamura et al. | |
| 6,158,673 | A | 12/2000 | Toetschinger et al. | |
| 6,187,154 | B1 | 2/2001 | Yamaguchi et al. | |
| 6,315,886 | B1 | 11/2001 | Zappi et al. | |
| 6,337,002 | B1 | 1/2002 | Kashimoto | |
| 6,632,347 | B1 | 10/2003 | Buckley et al. | |
| 7,303,660 | B2 | 12/2007 | Buckley et al. | |
| 2001/0022273 | A1 | 9/2001 | Popov et al. | |
| 2005/0126928 | A1 | 6/2005 | Hung et al. | |
| 2005/0183949 | A1* | 8/2005 | Daly | C02F 1/46104 204/242 |
| 2006/0260954 | A1 | 11/2006 | Sano et al. | |
| 2006/0283808 | A1 | 12/2006 | Kadlec et al. | |
| 2007/0007146 | A1 | 1/2007 | Childers, II et al. | |
| 2007/0051640 | A1 | 3/2007 | Bellamy | |
| 2007/0108064 | A1 | 5/2007 | Buckley et al. | |
| 2007/0187263 | A1 | 8/2007 | Field et al. | |
| 2007/0207350 | A1 | 9/2007 | Highgate | |
| 2007/0231220 | A1 | 10/2007 | Agius et al. | |
| 2008/0190763 | A1 | 8/2008 | Del Signore | |
| 2008/0210552 | A1 | 9/2008 | Del Signore | |
| 2008/0230381 | A1 | 9/2008 | Krstajic et al. | |
| 2008/0264778 | A1 | 10/2008 | Joshi et al. | |
| 2009/0000944 | A1 | 1/2009 | Varcoe | |
| 2009/0008268 | A1 | 1/2009 | Salathe et al. | |
| 2009/0071883 | A1 | 3/2009 | Gomez | |
| 2009/0181107 | A1 | 7/2009 | Buckley et al. | |
| 2011/0042202 | A1 | 2/2011 | Pettee et al. | |
| 2011/0120857 | A1 | 5/2011 | Uchida et al. | |

FOREIGN PATENT DOCUMENTS

| | | | | |
|---|---|---|---|---|
| CN | 102292491 | A | 12/2011 | |
| DE | 202005015370 | | 2/2006 | |
| DE | 102006058454 | | 6/2008 | |
| EP | 1007478 | | 6/2000 | |
| EP | 1238945 | A1 * | 9/2002 | C02F 1/4618 |
| EP | 1728768 | | 12/2006 | |
| EP | 1878704 | | 1/2008 | |
| EP | 2191721 | | 6/2010 | |
| EP | 2239231 | | 10/2010 | |
| JP | 2149395 | | 6/1990 | |
| JP | 2000043724 | | 2/2000 | |
| WO | 9812144 | | 3/1998 | |
| WO | 0102285 | A1 | 1/2001 | |
| WO | 2008131389 | | 10/2008 | |
| WO | 2009115577 | | 9/2009 | |
| WO | 2010012792 | | 2/2010 | |
| WO | 2010037389 | | 4/2010 | |

OTHER PUBLICATIONS

"Sodium Hypochlorite", Datasheet, available prior to Nov. 4, 2013, 10 pages.

Extended European Search Report dated Jan. 13, 2016 for European Application No. 13809128, filed Jun. 28, 2013.

Chinese Office Action and English Translation dated Mar. 24, 2016 for Chinese Application No. 201380034615.X, filed Dec. 29, 2014.

International Search Report and Written opinion dated Sep. 27, 2013 from International Application No. PCT/US2013/048483.

Office Action dated Dec. 31, 2015 from the USPTO for corresponding U.S. Appl. No. 13/929,144, filed Jun. 27, 2013.

Final Office Action dated Nov. 7, 2016, for U.S. Appl. No. 13/929,144, filed Jun. 27, 2013.

Pentair Everpure, "Understanding Water Softening", retrieved Oct. 29, 2016 (dated Dec. 2, 20008) from http://www.everpuresecure.com/know%20your%20water/Pages/Understanding-Water-Sofetning.aspx.

Wright's Training, "Water SOFTENING", Oct. 15, 2010 capture of http://www.wrights-trainingsite.com/softeningonb.html, using Internet Archive Wayback Machine.

English translation of Chinese Office Action dated Nov. 29, 2016 for Chinese Application No. 201380034615.X.

European Office Action dated Nov. 2, 2016, for European Application No. 13809128.5.

* cited by examiner

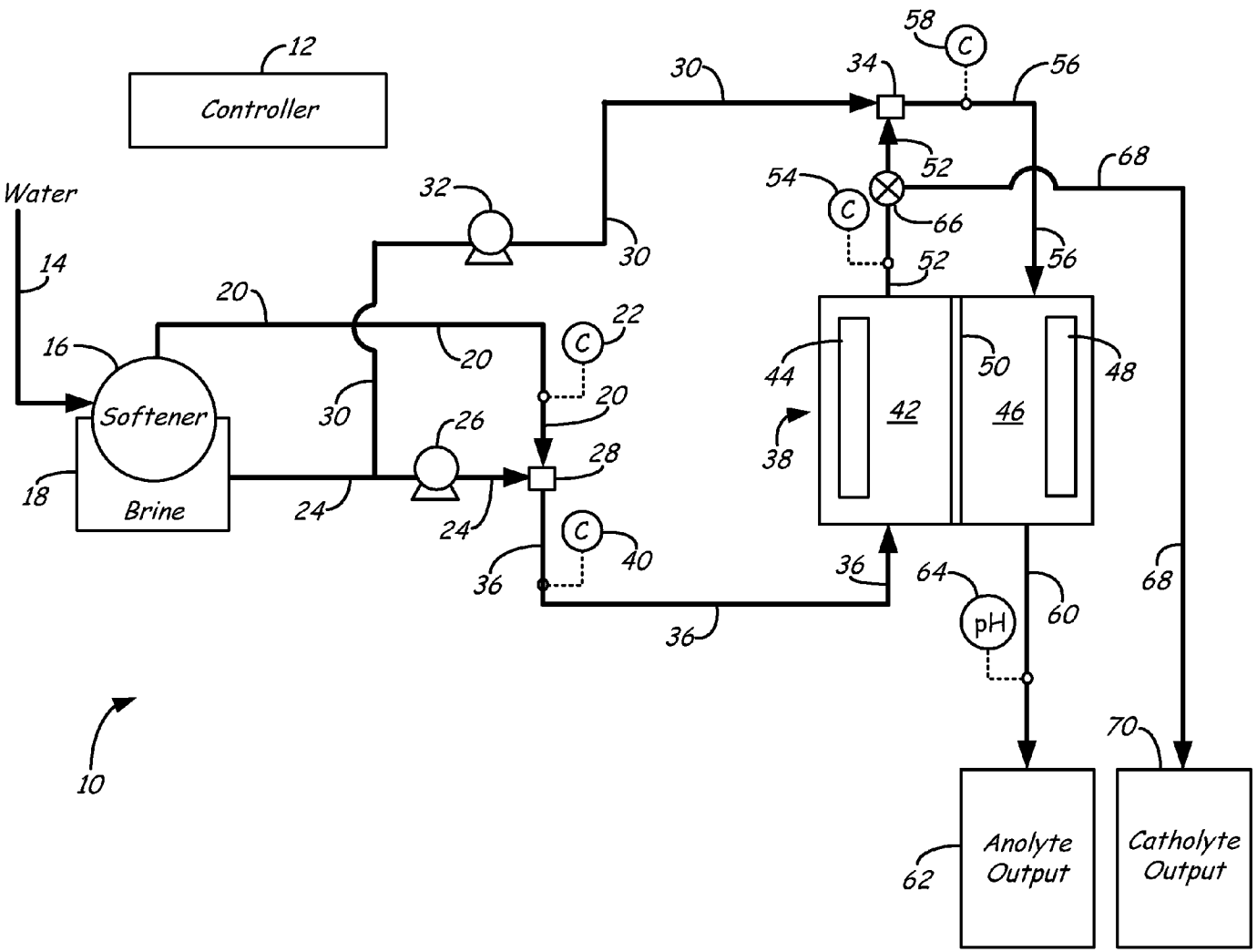
Controller
12
Water
14
Softener
16
Brine
18
20
22
24
26
28
30
32
34
36
38
40
42
44
46
48
50
52
54
56
58
60
62
64
66
68
70
Anolyte Output
Catholyte Output
pH
C
10

GENERATOR AND METHOD FOR FORMING HYPOCHLOROUS ACID

CROSS-REFERENCE TO RELATED APPLICATIONS(S)

The present application claims priority to U.S. Provisional Application No. 61/666,379, entitled "GENERATOR AND METHOD FOR FORMING HYPOCHLOROUS ACID", filed on Jun. 29, 2012.

BACKGROUND

The present disclosure relates cleaning and sanitizing systems, and in particular, to systems for generating hypochlorous acid (HOCl) with electrolysis reactions.

Electrolysis cells are used in a variety of different applications for changing one or more characteristics of a fluid. For example, electrolysis cells have been used in cleaning/sanitizing applications, medical industries, and semiconductor manufacturing processes. Electrolysis cells have also been used in a variety of other applications and have had different configurations. For cleaning/sanitizing applications, electrolysis cells are used to create anolyte liquids and catholyte liquid. Anolyte liquids have known sanitizing properties, and catholyte liquids have known cleaning properties.

SUMMARY

An aspect of the present disclosure is directed to a system for generating hypochlorous acid. The system includes an electrolysis cell having a barrier separating a cathode chamber and an anode chamber, and a first source configured to deliver a first salt solution to the cathode chamber. The system also includes a second source configured to deliver a second salt solution from the second source to the anode chamber, where the second salt solution has a greater salt concentration than that of the first salt solution. The electrolysis cell is configured to generate a catholyte stream from the first salt solution in the cathode chamber and an anolyte stream from the second salt solution in the anode chamber, where the anolyte stream comprises hypochlorous acid.

Another aspect of the present disclosure is directed to a system for generating hypochlorous acid, where the system includes an electrolysis cell, first and second sources, and a controller. The first source is configured to deliver a first salt solution to an cathode chamber of the electrolysis cell, and the second source is configured to deliver a second salt solution from the second source to an anode chamber of the electrolysis cell. The controller is configured to control salt concentrations in the first and second salt solutions such that the second salt solution has a greater salt concentration than the first salt solution. The controller is further configured to operate the electrolysis cell to generate a catholyte stream from the cathode chamber and an anolyte stream from the anode chamber, where the anolyte stream comprises hypochlorous acid, and to redirect at least a portion of the catholyte stream to the second fluid line such that the second salt solution comprises the portion of the catholyte stream.

Another aspect of the present disclosure is directed to a method for generating hypochlorous acid. The method includes introducing a first salt solution having a first salt concentration to a cathode chamber of an electrolysis cell, and introducing a second salt solution having a second salt concentration to an anode chamber of the electrolysis cell, where the second salt concentration is greater than the first salt concentration. The method also includes inducing an electrical current across the electrolysis cell to generate a catholyte stream from the first salt solution in the cathode chamber and an anolyte stream from the second salt solution in the anode chamber, where the anolyte stream comprises hypochlorous acid.

BRIEF DESCRIPTION OF THE DRAWINGS

The FIGURE is a schematic illustration of a generator of the present disclosure for electrochemically generating hypochlorous acid.

DETAILED DESCRIPTION

The present disclosure is directed to a generator and method for electrochemically generating hypochlorous acid (HOCl) from a salt solution (e.g., sodium chloride (NaCl) solution) using electrolysis. Hypochlorous acid is typically used as a disinfectant to kill microorganism-based contaminants. As such, the generator may be a stationary generator configured to dispense the generated hypochlorous acid to fill mobile units (e.g., mobile floor cleaners), or may be an onboard generator utilized in mobile cleaning units.

As discussed below, the generator includes an electrolysis cell having a cathode chamber and an anode chamber. The salt concentration of a first salt solution entering the cathode chamber is substantially less than the salt concentration of a second salt solution entering the anode chamber. This increases the production of hypochlorous acid in a resulting anolyte stream, providing an effective disinfectant. Additionally, a catholyte stream produced from the cathode chamber itself is fairly clean (i.e., low salt concentration), allowing the catholyte stream to be used for cleaning purposes while minimizing salt-based residues.

Furthermore, the generator may incorporate a double-conductivity measurement arrangement to maintain the salt concentrations in two separate streams, using two separate pumps and/or valves. This arrangement includes a first pair of conductivity sensors to ensure that a first preset salt concentration is maintained in the first salt solution entering the cathode chamber of the electrolysis cell. This arrangement also includes a second pair of conductivity sensors to ensure that a second preset salt concentration is maintained in the second salt solution entering the anode chamber of the electrolysis cell. Moreover, in the embodiment discussed below, at least a portion of the catholyte stream produced from the cathode chamber is recirculated to the anode chamber.

The FIGURE illustrates an example embodiment of a generator of the present disclosure, referred to as generator 10, for electrochemically generating and dispensing hypochlorous acid. Generator 10 may be utilized in combination with any suitable electrolysis-based dispensing system (e.g., in stationary generators and/or in mobile units), and includes controller 12. Controller 12 includes one or more control circuits configured to monitor and operate the components of generator 10 over one or more power and communication lines (e.g., electrical, optical, and/or wireless lines, not shown).

For example, one or more of the control functions performed by controller 12 can be implemented in hardware, software, firmware, etc., or a combination thereof. Such software, firmware, etc. may stored on a non-transitory computer-readable medium, such as a memory device. Any computer-readable memory device can be used, such as a disc drive, a solid state drive, CD-ROM, DVD, flash memory, RAM, ROM, a set of registers on an integrated circuit, etc. For example, the control circuit can be implemented partly or completely in a programmable logic controller and/or a processing device such as a microcontroller and/or other processor that executes instructions stored in a memory device, wherein the instructions are configured to perform the steps of the control process when executed by the processor device to convert the processing device into a special purpose computer.

Controller 12 and the components of generator 10 may be powered from one or more external and/or internal power sources (not shown). While not shown, generator 10 may also include a variety of additional flow control mechanisms, such as additional flow valves, pressure regulators, temperature sensors, pressure sensors, pH sensors, conductivity sensors, and the like, each of which may be monitored and/or operated by controller 12.

As shown, generator 10 operates by supplying input water through water line 14 to water softener 16 at a desired flow rate. Water line 14 may be any suitable supply source of water or other suitable liquid. Water entering generator 10 through water line 14 may also pass through an input filter (not shown) prior to entering water softener 16, and desirably has a suitable pressure to maintain a suitable flow rate through generator 10. Suitable inlet pressures for the water entering generator 10 range from about 2 bars (about 30 pounds/square inch (psi)) to about 7 bars (about 100 psi), for example.

Water softener 16 is configured to receive the water from water line 14 and to soften the water with a core resin, for example, prior to further relaying the water through generator 10. Examples of suitable assemblies for water softener 16 and a corresponding brine tank 18 include those disclosed in Guastella et al., U.S. patent application Ser. No. 13/410,535. A portion of the water introduced to water softener 16 may also be introduced into brine tank 18 to form a brine solution, which is a saturated solution of sodium chloride in water, for example. The amount of water introduced from water softener 16 into brine tank 18 may be regulated by controller 12 or a separate control circuit with a flow control or flow restriction mechanism (not shown) to prevent the water from overflowing brine tank 18. Alternatively, brine tank 18 may be separate unit from water softener 16.

The softened water exits water softener 16 through water line 20, where the conductivity of the water through water line 20 may be monitored by controller 12 via conductivity sensor 22. Correspondingly, a first portion of the brine solution from brine tank 18 may be directed through brine line 24, such as with pump 26, to first mixing location 28. As also shown, a second portion of the brine solution from brine line 24 may be directed through brine line 30, such as with pump 32, to second mixing location 34.

At first mixing location 28, the brine solution from brine line 24 mixes (passively or actively) with the softened water from water line 20, which then flows through mixed line 36 to electrolysis cell 38. After mixing at first mixing location 28, the conductivity of the mixed solution through mixed line 36 may be monitored by controller 12 via conductivity sensor 40.

Controller 12 monitors the difference in conductivity measurements from conductivity sensors 22 and 40 to ensure the correct amount of the brine solution from brine line 24 is pumped to first mixing location 28. In particular, controller 12 may modulate pump 24 using a process control loop to maintain a preset salt concentration in the mixed solution flowing through mixed line 36. Examples of suitable salt concentrations in the mixed solution flowing through mixed line 36 range from about 100 parts-per-million (ppm) to about 200 ppm of salt by weight or volume.

In the shown embodiment, electrolysis cell 38 includes cathode chamber 42 (having cathode electrode 44), anode chamber 46 (having anode electrode 48), and barrier 50. Cathode electrode 44 includes one or more electrodes located in cathode chamber 42 and is connected to the power source (not shown), such as through controller 12. Anode electrode 48 includes one or more electrodes located in anode chamber 46 and may also be connected to the power source, such as through controller 12. Barrier 50 includes a membrane (e.g., an ion exchange membrane) or other diaphragm that separates cathode chamber 42 and anode chamber 46.

During operation, the mixed solution from mixed line 36 enters cathode chamber 42. Controller 12 may apply a voltage to cathode electrode 44 and anode electrode 48, inducing an electrical current across electrolysis cell 38. This electrolyzes the solutions passing through electrolysis cell 38. As such, the mixed solution that flows through cathode chamber 42 from mixed line 36 is electrolyzed to form a catholyte stream that exits cathode chamber 42 through catholyte line 52. While flowing through catholyte line 52, controller 12 may monitor the conductivity of the catholyte stream via conductivity sensor 54.

At second mixing location 34, the brine solution from brine line 30 mixes (passively or actively) with the catholyte stream from catholyte line 52, which then flows through mixed line 56 to anode chamber 46 of electrolysis cell 38. After mixing at second mixing location 34, controller 12 may also monitor the conductivity of the mixed stream through mixed line 56 via conductivity sensor 58.

Controller 12 monitors the difference in conductivity measurements from conductivity sensors 54 and 58 to ensure the correct amount of the brine solution from brine line 30 is pumped to second mixing location 34. In particular, controller 12 may modulate pump 32 using a process control loop to maintain a preset salt concentration in the mixed stream flowing through mixed line 56. Examples of suitable salt concentrations in the mixed solution flowing through mixed line 56 range from about 1,000 ppm to about 3,000 ppm of salt by weight or volume. This salt concentration of the mixed solution entering anode chamber 46 is substantially greater than the concentration of the mixed solution entering cathode chamber 42, such as from about 10 to about 15 times greater, for example.

The mixed stream that flows through anode chamber 46 from mixed line 56 is electrolyzed to form an anolyte stream, which exits anode chamber 46 through anolyte line 60 to anolyte output 62. While flowing through anolyte line 60, controller 12 may monitor the pH of the anolyte stream via pH sensor 64.

As further shown, generator 10 includes pump or valve 66 along catholyte line 52, which controller 12 may operate to redirect portions of the catholyte stream flowing through catholyte line 52 to output line 68 and catholyte output 70. Thus, controller 12 may monitor the pH of the anolyte stream through anolyte line 60 (via pH sensor 64) and modulate valve (or pump) 66 using a process control loop to control the pH of the anolyte stream to within a preset range. The preset range is desirably set to maximize the amount of hypochlorous acid that is produced in the anolyte stream. An example of a suitable pH range includes a pH from about 5 to about 7.

If the measured pH of the anolyte stream flowing through anolyte line 60 is greater than this preset range (i.e., too basic), controller 12 may operate valve 66 to redirect a greater amount of the catholyte stream from catholyte line 52 to output line 68, thereby reducing the flow rate of the catholyte stream into second mixing location 34. This reduces the amount of the catholyte stream that is recirculated to anode chamber 46, and increases the amount of the catholyte stream that flows through output line 68 to catholyte output 70. Controller 12 may also modulate pump 32, if necessary, to maintain the desired concentration of salt in the mixed solution that enters anode chamber 46 from mixed line 56.

Alternatively, if the measured pH of the anolyte stream flowing through anolyte line 60 is less than this preset range (i.e., to acidic), controller 12 may direct valve 66 to redirect a lesser amount (or none) of the catholyte stream from catholyte line 52 to output line 68, thereby increasing the flow rate of the catholyte stream into second mixing location 34. This increases the amount of the catholyte stream that is recirculated to anode chamber 46, and decreases the amount of the catholyte stream that flows through output line 68 to catholyte output 70. Controller 12 may also modulate pump 32, if necessary, to maintain the desired concentration of salt in the mixed solution that enters anode chamber 46 from mixed line 56.

The resulting anolyte stream from anolyte output 62 may then be used for purposes of disinfecting surfaces and areas, for example. Additionally, the catholyte stream from catholyte output 70 may also be used, if desired, for cleaning purposes. Anolyte output 62 and/or catholyte output 70 may include any suitable output or dispensing device. For example, anolyte output 62 and/or catholyte output 70 may each be any suitable dispenser, such as a hand-activated nozzle (e.g., similar to a gas pump nozzle) that a user may hold and activate (e.g., with a trigger or lever) to dispense the desired output solution from generator 10.

As can be appreciated, the salt concentration of the mixed solution entering cathode chamber 42 is substantially less than the salt concentration of the catholyte solution entering anode chamber 46. This increases the production of hypochlorous acid in the resulting anolyte stream flowing through anolyte line 60, providing an effective disinfectant. Additionally, the catholyte stream from catholyte output 70 itself is fairly clean (i.e., low salt concentration), allowing the catholyte stream to be used for cleaning purposes while significantly reducing salt-based residues.

Furthermore, as mentioned above, generator 10 incorporates a double-conductivity measurement arrangement to maintain the salt concentrations in two separate streams (e.g., the mixed solutions flowing through mixed lines 36 and 56), using two separate pumps and/or valves (e.g., pumps 26 and 32).

For example, water line 14, water softener 16, brine tank 18, water line 20, conductivity sensor 22, brine line 24, pump 26, mixing location 28, mixed line 36, and/or conductivity sensor 40 may collectively be referred to as a first source for forming and directing the first mixed solution (i.e., a first salt solution) to cathode chamber 42. Additionally, brine line 30, pump 32, mixing location 34, catholyte line 52, conductivity probe 54, mixed line 56, conductivity probe 58, and/or pump or valve 66 may collectively be referred to as a second source for forming and directing the second mixed solution (i.e., a second salt solution) to anode chamber 46.

This allows controller 12 to monitor a first pair of conductivity sensors (e.g., sensors 22 and 40) to ensure that a first preset salt concentration is substantially maintained in the mixed solution entering the cathode chamber 42. This also allows controller 12 to monitor a second pair of conductivity sensors (e.g., sensors 54 and 58) to ensure that a second preset salt concentration is substantially maintained in the mixed solution that enters anode chamber 46. This allows the preset salt concentrations to be substantially maintained at desired levels to consistently provide high-quality hypochlorous acid to anolyte output 62 for use as a disinfectant to kill microorganism-based contaminants, for example.

Although the present disclosure has been described with reference to preferred embodiments, workers skilled in the art will recognize that changes may be made in form and detail without departing from the spirit and scope of the disclosure.

The invention claimed is:

1. A system for generating hypochlorous acid, the system comprising:

an electrolysis cell having a barrier separating a cathode chamber and an anode chamber;

a water line configured to receive water;

a brine source configured to provide a brine solution;

a first source configured to control a mixture of the water from the water line and the brine solution from the brine source and deliver a first salt solution at a first salt concentration to the cathode chamber through a first fluid line;

a second source configured to mix the brine solution from the brine source and at least a portion of a catholyte stream from the cathode chamber and deliver a second salt solution from the second source to the anode chamber through a second fluid line, the second salt solution having a second salt concentration, wherein the first source controls the mixture of the water from the water line and the brine solution from the brine source so that the first salt solution maintains the first salt concentration, and wherein the first salt concentration is smaller than the second salt concentration; and wherein the electrolysis cell is configured to generate the catholyte stream from the first salt solution in the cathode chamber and an anolyte stream from the second salt solution in the anode chamber, the anolyte stream comprising hypochlorous acid.

2. The system of claim 1, wherein the first source is configured to control the mixture of the water and the brine solution so that the salt concentration of the first salt solution ranges from about 100 parts-per-million by weight to about 300 parts-per-million by weight, based on an entire weight of the first salt solution.

3. The system of claim 2, wherein the second source is configured to control the mixture of the brine solution and the portion of the catholyte stream so that the salt concentration of the second salt solution ranges from about 1,000 parts-per-million by weight to about 3,000 parts-per-million by weight, based on an entire weight of the second salt solution.

4. The system of claim 1, wherein the first source comprises:

a first brine line configured to receive the brine solution from the brine source;

a first pump configured to move the brine solution through the first brine line; and a first mixing location configured to receive the water from the water line and the brine solution from the first brine line, and to output the mixture of the water and the brine solution as the first salt solution in the first fluid line, wherein the first pump is controlled so that the first salt solution has the first salt concentration.

5. The system of claim 4, and further comprising:

a first conductivity sensor configured to detect a conductivity of the water flowing through the water line;

a second conductivity sensor configured to detect a conductivity of the first salt solution flowing through the first fluid line; and a controller, which controls the first pump as a function of the conductivities detected by the first and second conductivity sensors to maintain the first salt solution at the first salt concentration.

6. The system of claim 4, wherein the second source comprises:

a second brine line configured to receive the brine solution from the brine source;

a second pump configured to move the brine solution through the second brine line; and a second mixing location configured to receive the brine solution from the second brine line and the portion of the catholyte stream from the cathode chamber, and to output the mixture of the second brine solution and the portion of the catholyte stream as the second salt solution in the second fluid line.

7. The system of claim 6, and further comprising:

a first conductivity sensor configured to detect a conductivity of the brine solution flowing through the second brine line; and a second conductivity sensor configured to detect a conductivity of the second salt solution flowing through the second fluid line, wherein the controller controls the second pump as a function of the conductivities detected by the first and second conductivity sensors to maintain the second salt solution at the second salt concentration.

8. The system of claim 6, and further comprising a redirection valve or pump configured to regulate the portion of the catholyte stream that flows to the second mixing location.

9. A system for generating hypochlorous acid, the system comprising:

an electrolysis cell having a barrier separating a cathode chamber and an anode chamber;

a water line configured to receive water;

a brine source configured to provide a brine solution;

a first brine line configured to receive the brine solution from the brine source;

a first pump configured to move the brine solution through the first brine line;

a first mixing location configured to receive the water from the water line and the brine solution from the first brine line, and to output a mixture of the water and the brine solution as a first salt solution to the cathode chamber, in a first fluid line, wherein the first pump is controlled so that the first salt solution maintains a first salt concentration;

a second brine line configured to receive the brine solution from the brine source;

a second pump configured to move the brine solution through the second brine line;

a second mixing location configured to receive the brine solution from the second brine line and at least a portion of a catholyte stream from the cathode chamber, and to output a mixture of the second brine solution and the portion of the catholyte stream as a second salt solution to the anode chamber, in a second fluid line;

a controller configured to:

control the first and second pumps so as to maintain the first and second salt concentrations in the first and second salt solutions respectively, such that the first salt solution has a smaller salt concentration than the second salt solution;

operate the electrolysis cell to generate the catholyte stream from the cathode chamber and an anolyte stream from the anode chamber, the anolyte stream comprising hypochlorous acid; and redirect the portion of the catholyte stream to the second mixing location such that the second salt solution comprises the portion of the catholyte stream.

10. The system of claim 9, and further comprising:

a first conductivity sensor configured to detect a conductivity of the water flowing through the water line; and a second conductivity sensor configured to detect a conductivity of the first salt solution flowing through the first fluid line;

wherein the controller is configured to control the first pump as a function of the conductivities detected by the first and second conductivity sensors to maintain the first salt solution at the first salt concentration.

11. The system of claim 10, and further comprising:

a third conductivity sensor configured to detect a conductivity of the water flowing through the second brine line; and a fourth conductivity sensor configured to detect a conductivity of the second salt solution flowing through the second fluid line;

wherein the controller is configured to control the second pump as a function of the conductivities detected by the third and fourth conductivity sensors to maintain the second salt solution at the second salt concentration.

12. The system of claim 9, and further comprising:

a redirection valve or pump configured to regulate the portion of the catholyte stream that flows to the second mixing location; and a pH sensor configured to detect a pH of the anolyte stream, wherein the controller is configured to communicate with the pH sensor to regulate the redirection valve or pump.

13. A method for generating hypochlorous acid, the method comprising:

supplying a brine solution from a brine source;

mixing the brine solution with water at a first mixing location;

controlling the mixing of the brine solution and the water to deliver a first salt solution at a first salt concentration;

introducing the first salt solution to a cathode chamber of an electrolysis cell through a first fluid line;

mixing the brine solution from the brine source with at least a portion of a catholyte stream from the cathode chamber at a second mixing location;

controlling the mixing of the brine solution and the portion of the catholyte stream from the cathode chamber to deliver a second salt solution at a second salt concentration, wherein the first salt solution is controlled to be smaller than the second salt concentration;

introducing the second salt solution to an anode chamber of the electrolysis cell through a second fluid line; and inducing an electrical current across the electrolysis cell to generate the catholyte stream from the first salt solution in the cathode chambers and an anolyte stream from the second salt solution in the anode chamber, the anolyte stream comprising hypochlorous acid.

14. The method of claim 13, and further comprising:

detecting a first conductivity of the water prior to mixing the water with the brine solution at the first mixing location;

detecting a second conductivity of the first salt solution; and adjusting a flow rate of the first brine solution to the first mixing location based at least in part on a difference in the detected first and second conductivities.

15. The method of claim 13, wherein the method further comprises:

detecting a first conductivity of the catholyte stream;

detecting a second conductivity of the second salt solution; and adjusting a flow rate of the brine solution to the second mixing location based at least in part on a difference in the detected first and second conductivities.

16. The method of claim 13, further comprising:

detecting a pH of the anolyte stream; and adjusting an amount of the portion of the catholyte stream that is directed to the second mixing location based at least in part on the detected pH.

* * * * *